US007482899B2

(12) United States Patent
Shen et al.

(10) Patent No.: US 7,482,899 B2
(45) Date of Patent: Jan. 27, 2009

(54) ELECTROMECHANICAL LATCHING RELAY AND METHOD OF OPERATING SAME

(76) Inventors: Jun Shen, 1956 E. Desert Willow Dr., Phoenix, AZ (US) 85048; Chengping Wei, 549 E. Sheffield Ave., Gilbert, AZ (US) 85296

( * ) Notice: Subject to any disclaimer, the term of this patent is extended or adjusted under 35 U.S.C. 154(b) by 0 days.

(21) Appl. No.: 11/534,655

(22) Filed: Sep. 24, 2006

(65) Prior Publication Data

US 2007/0075809 A1 Apr. 5, 2007

Related U.S. Application Data

(60) Provisional application No. 60/725,335, filed on Oct. 2, 2005.

(51) Int. Cl.
*H01H 51/22* (2006.01)

(52) U.S. Cl. ..... 335/78

(58) Field of Classification Search ..... 335/78
See application file for complete search history.

(56) References Cited

U.S. PATENT DOCUMENTS

| | | | | |
|---|---|---|---|---|
| 5,051,643 | A * | 9/1991 | Dworsky et al. | 310/309 |
| 5,398,011 | A * | 3/1995 | Kimura et al. | 335/79 |
| 5,475,353 | A * | 12/1995 | Roshen et al. | 335/78 |
| 5,703,550 | A | 12/1997 | Pawlak et al. | |
| 5,818,316 | A | 10/1998 | Shen et al. | |
| 5,847,631 | A * | 12/1998 | Taylor et al. | 335/78 |
| 5,889,452 | A * | 3/1999 | Vuilleumier | 335/80 |
| 5,945,898 | A | 8/1999 | Judy et al. | |
| 5,994,986 | A * | 11/1999 | Takahashi | 335/78 |
| 6,016,092 | A * | 1/2000 | Qiu et al. | 333/262 |
| 6,084,281 | A | 7/2000 | Fullin et al. | |

(Continued)

FOREIGN PATENT DOCUMENTS

JP 56023717 A * 3/1981

(Continued)

OTHER PUBLICATIONS

Engineers' Relay Handbook, 5th Edition, published by National Association of Relay Manufacturers, 1996.

*Primary Examiner*—Elvin Enad
*Assistant Examiner*—Mohamad A Musleh

(57) ABSTRACT

A latching relay employing a movable cantilever with a first permanent magnet and a nearby second magnet is disclosed. The permanent magnet affixed to the cantilever is permanently magnetized along its long (horizontal) axis. The cantilever has a first end associated to the first pole (e.g., north pole) of the first magnet, and a second end associated to the second pole (e.g., south pole) of the first magnet. When the first end of the cantilever approaches the second magnet, the first pole of the first magnet induces a local opposite pole (e.g., south pole) in the second magnet and causes the first end of the cantilever to be attracted to the local opposite pole of the second magnet, closing an electrical conduction path (closed state). An open state on the first end of cantilever 10 can be maintained either by the second pole of first magnet being attracted to a local opposite pole in the second magnet or by a mechanical restoring force of flexure spring which supports the cantilever. A magnetic generator provides a third magnetic field about the first magnet and produces a torque on the associated cantilever to force the cantilever to switch in one of the closed, neutral and open states.

20 Claims, 2 Drawing Sheets

Front view.

U.S. PATENT DOCUMENTS 6,094,116 A 7/2000 Tai et al.
6,124,650 A 9/2000 Bishop et al.
6,143,997 A 11/2000 Feng et al.
6,153,839 A * 11/2000 Zavracky et al. ..... 200/181
6,252,229 B1 * 6/2001 Hays et al. ..... 250/338.4
6,384,353 B1 * 5/2002 Huang et al. ..... 200/181
6,410,360 B1 * 6/2002 Steenberge ..... 438/52
6,469,602 B2 10/2002 Ruan et al.
6,469,603 B1 10/2002 Ruan et al.
6,492,887 B1 * 12/2002 Diem et al. ..... 335/78
6,633,158 B1 * 10/2003 Shen et al. ..... 324/207.26
6,750,745 B1 * 6/2004 Wei et al. ..... 335/78
6,778,046 B2 * 8/2004 Stafford et al. ..... 335/78
6,794,965 B2 * 9/2004 Shen et al. ..... 335/78
6,894,592 B2 * 5/2005 Shen et al. ..... 335/78
7,023,304 B2 * 4/2006 Shen et al. ..... 335/78
7,027,682 B2 * 4/2006 Ruan et al. ..... 385/18
7,151,426 B2 * 12/2006 Stafford et al. ..... 335/78
7,183,884 B2 * 2/2007 Shen et al. ..... 335/78
7,202,765 B2 * 4/2007 Shen et al. ..... 335/78
7,215,229 B2 * 5/2007 Shen et al. ..... 335/78
7,250,838 B2 * 7/2007 Shen et al. ..... 335/78
7,253,710 B2 * 8/2007 Shen et al. ..... 335/78
2002/0121951 A1 * 9/2002 Shen et al. ..... 335/78
2002/0196110 A1 * 12/2002 Vaitkus et al. ..... 335/78
2003/0025580 A1 * 2/2003 Wheeler et al. ..... 335/78
2005/0007218 A1 * 1/2005 Shen et al. ..... 335/78
2005/0083156 A1 * 4/2005 Shen et al. ..... 335/78
2005/0116798 A1 * 6/2005 Bintoro et al. ..... 335/78
2005/0285703 A1 * 12/2005 Wheeler et al. ..... 335/78
2006/0044088 A1 * 3/2006 Vaitkus et al. ..... 335/78

FOREIGN PATENT DOCUMENTS

JP 05243038 A * 9/1993

* cited by examiner

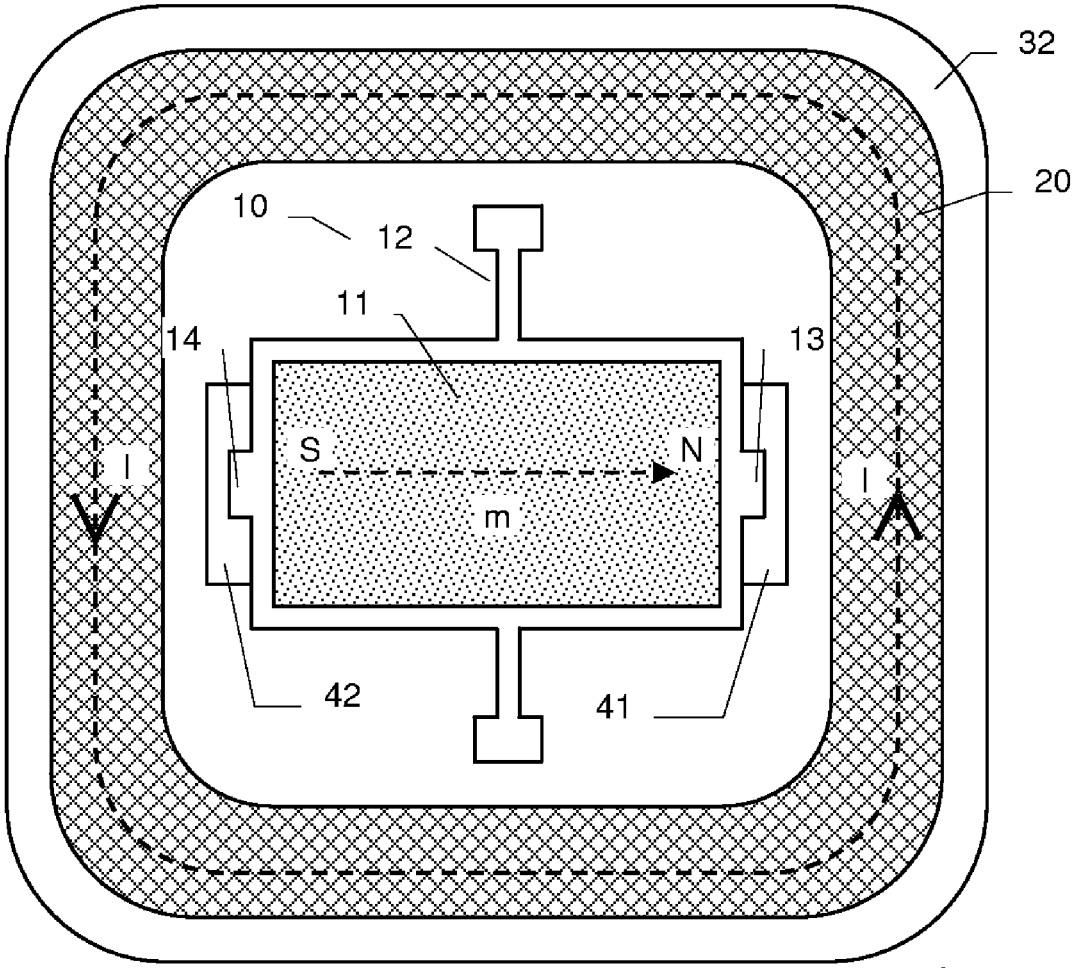
Figure 1A. Top view.
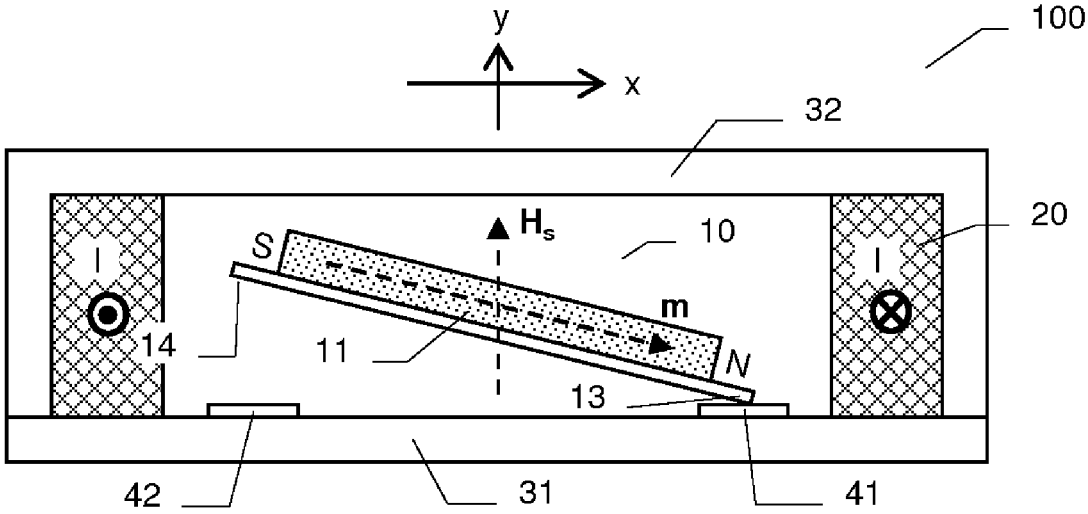
Figure 1B. Front view.

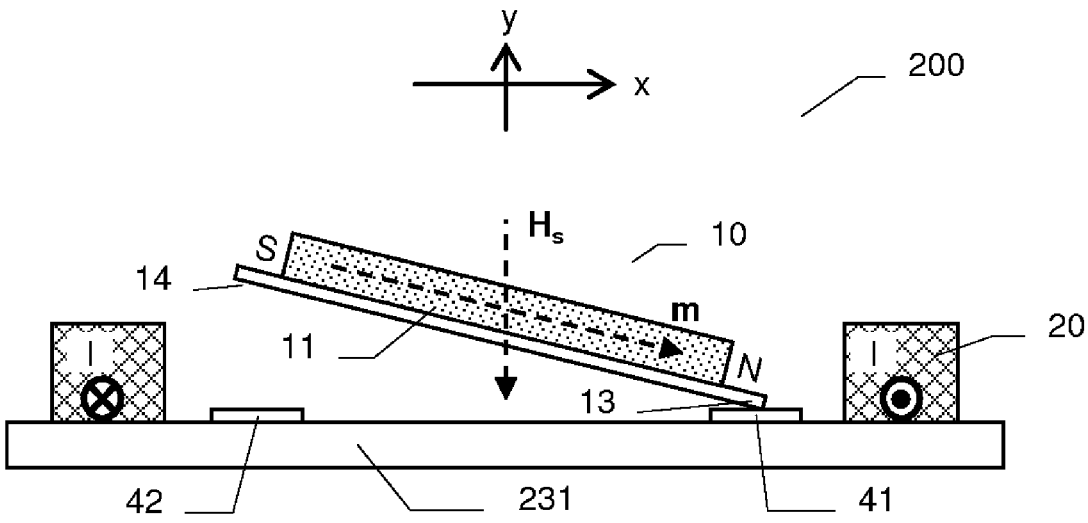
Figure 2. Front view
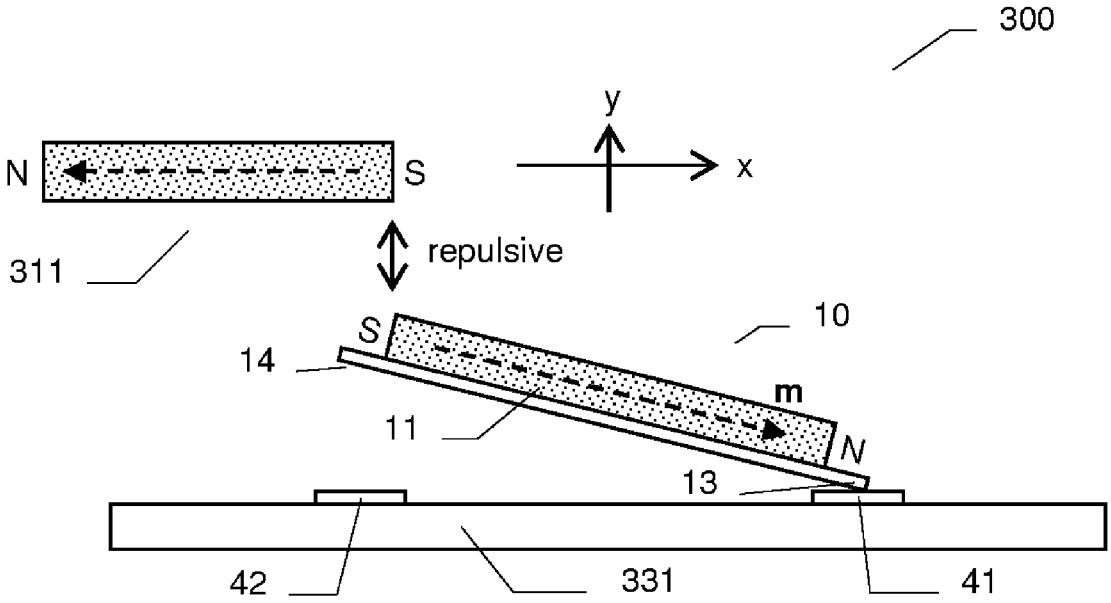
Figure 3. Front view

ELECTROMECHANICAL LATCHING RELAY AND METHOD OF OPERATING SAME

CROSS REFERENCE TO RELATED APPLICATIONS

This patent application claims the benefit of U.S. Provisional Patent Application Ser. No. 60/725,335, filed on Oct. 2, 2005, which is hereby incorporated by reference.

FIELD OF THE INVENTION

The present invention relates to relays. More specifically, the present invention relates to latching electromechanical relays and to methods of operating and formulating electromechanical relays.

BACKGROUND OF THE INVENTION

Relays are electromechanical switches operated by a flow of electricity in one circuit and controlling the flow of electricity in another circuit. A typical relay comprises basically an electromagnet with a soft iron bar, called an armature, held close to it. A movable contact is connected to the armature in such a way that the contact is held in its normal position by a spring. When the electromagnet is energized, it exerts a force on the armature that overcomes the pull of the spring and moves the contact so as to either complete or break a circuit. When the electromagnet is de-energized, the contact returns to its original position. Variations on this mechanism are possible: some relays have multiple contacts; some are encapsulated; some have built-in circuits that delay contact closure after actuation; some, as in early telephone circuits, advance through a series of positions step by step as they are energized and de-energized, and some relays are of latching type.

Latching relays are the types of relays which can maintain closed and open contact positions without energizing an electromagnet. Short current pulses are used to temporally energize the electromagnet and switch the relay from one contact position to the other. An important advantage of latching relays is that they do not consume power (actually they do not need a power supply) in the quiescent state.

Conventional electromechanical relays have traditionally been fabricated one at a time, by either manual or automated processes. The individual relays produced by such an "assembly-line" type process generally have relatively complicated structures and exhibit high unit-to-unit variability and high unit cost. Conventional electromechanical relays are also relatively large when compared to other electronic components. Size becomes an increasing concern as the packaging density of electronic devices continues to increase.

Many designs and configurations have been used to make latching electromechanical relays. Two forms of conventional latching relays are described in the Engineers' Relay Handbook (Page 3-24, Ref. [1]). A permanent magnet supplies flux to either of two permeable paths that can be completed by an armature. To transfer the armature and its associated contacts from one position to the other requires energizing current through the electromagnetic coil using the correct polarity. One drawback of these traditional latching relay designs is that they require the coil to generate a relatively large reversing magnetic field in order to transfer the armature from one position to the other. This requirement mandates a large number of wire windings for the coil, making the coil size large and impossible or very difficult to fabricate other than using conventional winding methods.

A non-volatile programmable switch is described in U.S. Pat. No. 5,818,316 issued to Shen et al. on Oct. 6, 1998, the entirety of which is incorporated herein by reference. The switch disclosed in this reference includes first and second magnetizable conductors having first and second ends, respectively, each of which is a north or south pole. The ends are mounted for relative movement between a first position in which they are in contact and a second position in which they are insulated from each other. The first conductor is permanently magnetized and the second conductor is switchable in response to a magnetic field applied thereto. Programming means are associated with the second conductor for switchably magnetizing the second conductor so that the second end is alternatively a north or south pole. The first and second ends are held in the first position by magnetic attraction and in the second position by magnetic repulsion.

Another latching relay is described in U.S. Pat. No. 6,469,602 B2 issued to Ruan et al. on Oct. 22, 2002 (claiming priority established by the Provisional Application No. 60/155,757, filed on Sep. 23, 1999), the entirety of which is incorporated herein by reference. The relay disclosed in this reference is operated by providing a cantilever sensitive to magnetic fields such that the cantilever exhibits a first state corresponding to the open state of the relay and a second state corresponding to the closed state of the relay. A first magnetic field may be provided to induce a magnetic torque in the cantilever, and the cantilever may be switched between the first state and the second state with a second magnetic field that may be generated by, for example, a conductor formed on a substrate with the relay.

Yet another non-volatile micro relay is described in U.S. Pat. No. 6,124,650 issued to Bishop et al. on Sep. 26, 2000, the entirety of which is incorporated herein by reference. The device disclosed in this reference employs square-loop latchable magnetic material having a magnetization direction capable of being changed in response to exposure to an external magnetic field. The magnetic field is created by a conductor assembly. The attractive or repulsive force between the magnetic poles keeps the switch in the closed or open state.

Each of the prior arts, though providing a unique approach to make latching electomechanical relays and possessing some advantages, has some drawbacks and limitations. Some of them may require large current for switching, and some may require precise relative placement of individual components. These drawbacks and limitations can make manufacturing difficult and costly, and hinder their value in practical applications.

Accordingly, it would be highly desirable to provide an easily switchable latching relay which is also simple and easy to manufacture and use.

It is a purpose of the present invention to provide a new and improved latching electromechanical relay.

It is another purpose of the present invention to provide a new and improved latching electromechanical relay which is easy to switch and simple and easy to manufacture and use.

SUMMARY OF THE INVENTION

The above problems and others are at least partially solved and the above purposes and others are realized in a relay including a first magnet mounted on a movable cantilever and a second magnet placed near the first magnet. The first magnet is permanently magnetized along its long (horizontal) axis. The cantilever has a first end associated to the first pole (e.g., north pole) of the first magnet, and a second end associated to the second pole (e.g., south pole) of the first magnet. When the first end of the cantilever approaches the second magnet, the first pole of the first magnet induces a local opposite pole (e.g., south pole) in the second magnet and causes the first end of the cantilever to be attracted to the local opposite pole of the second magnet, closing an electrical conduction path (closed state). An open state on the first end of the cantilever can be maintained either by the second pole of first magnet being attracted to a local opposite pole in the second magnet or by a mechanical restoring force of the flexure spring which supports the cantilever. A third electromagnet (e.g., a coil or solenoid), when energized, provides a third perpendicular magnetic field about the first magnet and produces a magnetic torque on the associated cantilever to force the cantilever to switch between closed and open states. A few alternate embodiments of the relay is also disclosed which include a case where the latching feature is disabled, and another case where an external magnet is used to switch the cantilever.

BRIEF DESCRIPTION OF THE FIGURES

The above and other features and advantages of the present invention are hereinafter described in the following detailed description of illustrative embodiments to be read in conjunction with the accompanying figures, wherein like reference numerals are used to identify the same or similar parts in the similar views, and:

FIG. 1A is a top view of an exemplary embodiment of a latching relay;

FIG. 1B is a front view of an exemplary embodiment of a latching relay;

FIG. 2 is a front view of an exemplary embodiment of a relay in which the latching feature is disabled;

FIG. 3 is a front view of an exemplary embodiment of a latching (or non-latching) switch in which an external magnet is used to switch the cantilever from one state to the other.

DETAILED DESCRIPTION OF EXEMPLARY EMBODIMENTS

It should be appreciated that the particular implementations shown and described herein are examples of the invention and are not intended to otherwise limit the scope of the present invention in any way. Indeed, for the sake of brevity, conventional electronics, manufacturing, and other functional aspects of the systems (and components of the individual operating components of the systems) may not be described in detail herein. Furthermore, for purposes of brevity, the invention is frequently described herein as pertaining to an electromagnetic relay for use in electrical or electronic systems. It should be appreciated that many other manufacturing techniques could be used to create the relays described herein, and that the techniques described herein could be used in mechanical relays, optical switches, fluidic control systems, or any other switching devices. Further, the techniques would be suitable for application in electrical systems, optical systems, consumer electronics, industrial electronics, wireless systems, space applications, fluidic control systems, medical systems, or any other application. Moreover, it should be understood that the spatial descriptions made herein are for purposes of illustration only, and that practical latching relays may be spatially arranged in any orientation or manner. Arrays of these relays can also be formed by connecting them in appropriate ways and with appropriate devices.

A Latching Relay

FIGS. 1A and 1B show top and front views, respectively, of a latching relay. With reference to FIGS. 1A and 1B, an exemplary latching relay 100 suitably includes a movable cantilever 10, a coil 20, soft magnetic layers 31 and 32, and electrical contacts 41 and 42.

Movable cantilever 10 comprises a permanent (hard) magnetic layer 11 (first magnet), flexure spring and support 12, and electrical contacts 13 and 14. Magnetic layer 11 is permanently magnetized (with a magnetic moment m) along the long axis of the cantilever (e.g., predominantly along the positive x-axis as shown). Cantilever 10 has a first (right) end associated to the first (north) pole of first magnet 11 and contact 13, and has a second (left) end associated to the second (south) pole of first magnet 11 and contact 14. Magnetic layer 11 can be any type of hard magnetic material that can retain a remnant magnetization in the absence of an external magnetic field and its remnant magnetization can not be easily demagnetized. In an exemplary embodiment, magnetic layer 11 is a thin SmCo permanent magnet with an approximate remnant magnetization ($B_r=\mu_0 M$) of about 1 T along its long axis (predominantly along the x-axis). Other possible hard magnetic materials are, for example, NdFeB, AlNiCo, Ceramic magnets (made of Barium and Strontium Ferrite), CoPtP alloy, and others, that can maintain a remnant magnetization ($B_r=\mu_0 M$) from about 0.001 T (10 Gauss) to above 1 ($10^4$ Gauss), with coercivity ($H_c$) from about $7.96\times 10^2$ A/m (10 Oe) to above $7.96\times 10^5$ A/m ($10^4$ Oe). Flexure spring and support 12 can be any flexible material that on one hand supports cantilever 10 and on the other allows cantilever 10 to be able to move and rotate. Flexure spring and support can be made of metal layers (such as Beryllium Copper, Ni, stainless steel, etc.), or non-metal layers (such as polyimide, Si, $Si_3Ni_4$, etc.). The flexibility of the flexure spring can be adjusted by its thickness, width, length, and shape, etc. Similarly, other structures (e.g., a raised bar, a hinge, etc.) can be used to support cantilever 10 for its seesaw motion. Electrical contacts 13 and 14 can be any electrically conducting layer such as Au, Ag, Rh, Ru, Pd, AgCdO, Tungsten, etc., or suitable alloys. Electrical contacts 13 and 14 can be formed onto the tips (ends) of the cantilever by electroplating, deposition, welding, lamination, or any other suitable means. Flexure spring and support 12 and electrical contacts 13 and 14 can be formed by either using one process and the same material, or by using multiple processes, multiple layers, and different materials. When the cantilever rotates and its two ends moves up or down, electrical contact 13 or 14 either makes or breaks the electrical connection with the bottom contact 41 or 42. Optional insulating layers (not shown) can be placed between the conducting layers to isolate electrical signals in some cases.

Coil 20 (the third electromagnet) is formed by having multiple windings of conducting wires around the cantilever. The conducting wires can be any conducting materials such as Cu, Al, Au, or others. The windings can be formed by either winding the conducting wires around a bobbin, or by electroplating, deposition, etching, laser forming, or other means used in electronics industry (e.g., semiconductor integrated circuits, printed circuit boards, etc.). One purpose of coil 20 in relay 100, when energized, is to provide a third perpendicular (y-axis) magnetic field ($H_s$) so that a magnetic torque ($T_s=\mu_0 m\times H_s$) can be created on cantilever 10. Because magnetic moment m is fixed, the direction and magnitude of the torque depends on the direction and magnitude of the current in coil 20. This arrangement provides a means for external electronic control of the relay switching between different states, as to be explained in detail below.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. One purpose of soft magnetic layers 31 and 32 is to cause an attractive force between the pole of hard magnetic layer 11 and the induced local opposite magnetic pole of the soft magnetic layer so that a stable contact force can be maintained between electrical contact 13 (or 14) and electrical contact 41 (or 42). Another purpose of soft magnetic layers 31 and 32 is to form a closed magnetic circuit and enhance the coil-induced magnetic flux density (third perpendicular magnetic field) in the cantilever region. Yet another purpose of soft magnetic layers 31 and 32 is to confine the magnetic field inside the cavity enclosed by soft magnetic layers 31 and 32 so that the magnetic interference between adjacent devices can be eliminated or reduced.

Electrical contacts 41 and 42 can be any electrically conducting layer such as Au, Ag, Rh, Ru, Pd, AgCdO, Tungsten, etc., or suitable alloys. Electrical contacts 41 and 42 can be formed on the surface of soft magnetic layer 31 by electroplating, deposition, welding, lamination, or any other suitable means. Alternatively, electrical contacts 41 and/or 42 can be formed on the surface of soft magnetic layer 32 by similar means. Optional insulating layers (not shown) can be placed between the conducting layers to isolate electrical signals in some cases. Transmission-line types of contacts and metal traces can also be suitably designed and formed for high performance radio-frequency applications.

Principle of Operation

In a broad aspect of the invention, the first pole (e.g., north pole) of first magnet 11 induces a local (e.g., near contact 41) opposite (e.g., south) pole in the soft magnetic layer 31 (second magnet) to produce an attractive force between the poles which forces electrical contact 13 toward electrical contact 41 and maintains good electrical conduction between the two contacts. To break the electrical contact and switch cantilever 10 to another state, coil 20 is energized with a short current pulse which produces a third predominantly perpendicular magnetic field ($H_s$). A clockwise or counter-clockwise torque can be produced on cantilever 10 through the interaction between the magnetic moment (m) of magnet 11 and the coil-induced magnetic field ($H_s$), depending on the direction of the coil current. The torque rotates cantilever 10 from one state to another for switching purposes.

With continued reference to FIGS. 1A and 1B, cantilever 10 can have three basic stable positions: (a) the first (right) end down (as shown); (b) the second (left) end down; and (c) neutral (leveled) position. When the first (right) end of cantilever 10 is down, the first (north) pole at the first end of first magnet 11 on cantilever 10 magnetizes the bottom second magnet (soft-magnetic layer) 31 in such a way that a local south pole is created. The attractive force between the first (north) pole of first magnet 11 and the induced south pole of second magnet 31 keeps the first (right) end of cantilever 10 in contact with contact layer 41. Additionally (optionally), the second (south) pole of the first magnet 11 on the second (left) end of cantilever 10 can induce a local north pole in soft-magnetic layer 32 near the second (south) pole of magnet 11, creating an additional attractive force pulling the second (left) end of cantilever 10 upward and effectively adding to the force pushing the first (right) end of cantilever 10 downward. The same principle applies to stable state (b). Neutral state (c) is possible because the attractive force between the magnetic poles is quite localized (the force magnitude is inversely proportional to the square of the pole separation). By designing appropriate stiffness of flexure spring 12, one can create a region (near leveled position) so that the spring mechanical restoring torque is larger than the magnetic torque due to the attractive forces between the magnetic poles so that cantilever 10 can maintain the leveled position within the region.

Switching between the stable states is accomplished by passing a short current pulse (I) through coil 20 to create a third predominantly perpendicular (along y-axis) magnetic field ($H_s$) in the cantilever region. An additional magnetic torque ($T_s=\mu_0 m \times H_s$) is produced on cantilever 10 which can cause the cantilever to rotate either clockwise or counter-clockwise (front view 1B) depending on the direction of the coil current (which determines $H_s$).

Switching can also be accomplished by using another external movable magnet (not shown). The interaction between the first magnet 11 and the external movable magnet can produce torques and forces on cantilever 10 for switching and electrical contacting purposes.

Some of the aforementioned advantages of the disclosed invention can be evidenced by the following exemplary analysis.

EXAMPLE 1

Assuming the first magnet having the following characteristics: length=4 mm (along long axis), width=4 mm, thickness=0.2 mm, volume V=length×width×thickness, remnant magnetization $B_r=\mu_0 M=1$ T, the magnetic moment $\mu_0 m=\mu_0 M \times V=3.2\times10^{-9}$ T·m$^3$. For a coil-induced magnetic field $\mu_0 H_s=0.05$ T ($H_s=500$ Oe), the induced magnetic torque about the length center is $T_s=\mu_0 m \times H_s=1.27\times10^{-4}$ m·N (assuming m is perpendicular to $H_s$) which corresponds to a force of $F_m=T_s/(\text{length}/2)=6.4\times10^{-2}$ N at the end of the first magnet. This force, combining with the flexure restoring force, needs to be larger than the pole attraction for cantilever switching. The above exemplary parameters show that for a relatively small coil-induced magnetic field ($H_s=500$ Oe), a significantly large torque and force can be generated. The torque and force can continue to increase with larger $H_s$ (correspondingly larger coil current). Another point worth noting is that when the angle between m and $H_s$ changes from perfectly perpendicular (90°) to 80°, the change in the magnitude of the torque (and force) is only 1.5%=1-98.5%=1-sin (80°), which gives a larger tolerance in production variations, simplifies the production process, and reduces costs.

EXAMPLE 2

Assuming all the dimensions of the first magnet are reduced by an order of magnitude: length=0.4 mm (along long axis), width=0.4 mm, thickness=0.02 mm, remnant magnetization $B_r=\mu_0 M=1$ T, the magnetic moment $\mu_0 m=\mu_0 M \times V=3.2\times10^{-12}$ T·m$^3$. For a coil-induced magnetic field $\mu_0 H_s=0.05$ T ($H_s=500$ Oe), the induced magnetic torque about the length center is $T_s=\mu_0 m \times H_s=1.27\times10^{-7}$ m·N (assuming m is perpendicular to $H_s$) which corresponds to a force of $F_m=T_s/(\text{length}/2)=6.4\times10^{-4}$ N at the end of the first magnet. The force is still quite large in such micro dimensions.

Fabricating a Latching Relay

It is understood that a variety of methods can be used to fabricate the latching relay. These methods include, but not limited to, semiconductor integrated circuit fabrication methods, printed circuit board fabrication methods, micro-machining methods, and so on. The methods include processes such as photo lithography for pattern definition, deposition, plating, screen printing, etching, lamination, molding, welding, adhering, bonding, and so on. The detailed descriptions of various possible fabrication methods are omitted here for brevity.

Alternate Embodiments of Latching Relays

FIG. 2 discloses an alternate exemplary embodiment of latching relay 100. In this embodiment, the latching feature is disabled. The basic relay 200 comprises a movable cantilever 10, a coil 20, a substrate 231, and the electrical contacts 41 and 42. Movable cantilever 10 comprises a permanent (hard) magnetic layer 11 (first magnet), flexure spring and support 12 (refer to FIG. 1A), and electrical contacts 13 and 14 (refer to FIG. 1A). Magnetic layer 11 is permanently magnetized (with a magnetic moment m) along the long axis of cantilever 10 (e.g., predominantly along the positive x-axis as shown). Substrate 231 can be any type of non-magnetic material (e.g., Si, GaAs, ceramic, FR4, polyimide, etc.) suitable as a base for fabricating coil 20, contacts 41 and 42, and cantilever 10. When coil 20 is not energized, cantilever 10 stays in its neutral (leveled) position. When current passes through coil 20, a third predominantly perpendicular magnetic field ($H_s$) is produced about cantilever 10. A magnetic torque ($T_s=\mu_0 m \times H_s$) is produced on cantilever 10 which can cause cantilever 10 to rotate either clockwise or counterclockwise depending on the direction of the coil current (which determines $H_s$). With the coil current direction shown in FIG. 2 (into paper on the left and out from paper on the right), the magnetic torque is clockwise which forces contact 13 toward contact 41 and maintains electrical connection between the two contacts. Similarly, contact 14 can be forced toward contact 42 by reversing the current flow direction in coil 20. When coil 20 is de-energized, cantilever 10 goes back to the neutral (leveled) position by the spring restoring torque, leaving both sides of electrical contacts open.

FIG. 3 discloses another exemplary embodiment of latching relay 100. In this embodiment, the coil switching feature is disabled. The basic device 300 comprises a movable cantilever 10, a substrate 331, electrical contacts 41 and 42, and an external movable magnetic body 311. Movable cantilever 10 comprises a first permanent (hard) magnetic layer 11, flexure spring and support 12 (refer to FIG. 1A), and electrical contacts 13 and 14 (refer to FIG. 1A). Magnetic layer 11 is permanently magnetized (with a magnetic moment m) along the long axis of cantilever 10 (e.g., predominantly along the positive x-axis as shown). Substrate 331 can be any type of magnetic (e.g., of the similar type specified for soft magnetic layer 31 in FIG. 1B) or non-magnetic material (e.g., of the similar type specified for substrate 231 in FIG. 2), depending on whether latching is desired. External magnet 311 can be made of hard magnetic material or soft magnetic material.

The operation of device 300 is first described for the case where substrate 331 is made of soft magnetic material, such as the type specified for soft magnetic layer 31 in FIG. 1B. In this case and in the absence of external magnet 311, the cantilever has three stable states as described in the text referring to FIG. 1. Electrical connections between contacts 13 (or 14) and 41 (or 42) can be either closed or open in each state. When external magnet 311 is brought into the vicinity of cantilever 10, the interaction between magnet 311 and magnet 11 can cause cantilever 10 to switch from one state to another. For example, as shown in FIG. 3, magnet 311 is permanently magnetized along the negative x-axis. When magnet 311 is brought in as shown in FIG. 3, the south pole of magnet 311 repels the south pole of magnet 11. When this repulsive force is larger than the attractive force between the north pole of magnet 11 and the induced local south pole of substrate 331 on the first (right) end of cantilever 10, cantilever 10 can be forced to rotate to the other state in which contact 14 is in contact with contact 42 (left-end down state). Other scenarios are also possible, and are omitted here for brevity.

The operation of device 300 is now described for the case where substrate 331 is made of non-magnetic material such as the type specified for substrate 231 in FIG. 2. In this case and in the absence of external magnet 311, cantilever 10 stays in its neutral (leveled) position and both electrical contacts are open. When external magnet 311 is brought into the vicinity of cantilever 10, the interaction between magnet 311 and magnet 11 can cause cantilever 10 to rotate and close between electrical contacts. For example, if magnet 311 is made of soft magnetic material (not shown in FIG. 3) and is brought near the south pole of magnet 11, a local north pole can be induced in magnet 311 and an attractive force can be produced between the two poles which in turn pulls the left end of cantilever 10 up and pushes the right end of cantilever 10 down so that contact 13 touches contact 41.

It will be understood that many other embodiments and combinations of difference choices of materials and arrangements could be formulated without departing from the scope of the invention. Similarly, various topographies and geometries of relay 100 could be formulated by varying the layout of the various components.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above.

REFERENCE

[1] Engineers' Relay Handbook, 5th Edition, published by National Association of Relay Manufacturers, 1996.
[2] U.S. Pat. No. 5,818,316, Shen et al.
[3] U.S. Pat. No. 6,469,602 B2, Ruan and Shen.
[4] U.S. Pat. No. 6,124,650, Bishop et al.
[5] U.S. Pat. No. 6,469,603 B1, Ruan and Shen.
[6] U.S. Pat. No. 5,398,011, Kimura et al.
[7] U.S. Pat. No. 5,847,631, Taylor and Allen.
[8] U.S. Pat. No. 6,094,116, Tai et al.
[9] U.S. Pat. No. 6,084,281, Fullin et al.
[10] U.S. Pat. No. 5,475,353, Roshen et al.
[11] U.S. Pat. No. 5,703,550, Pawlak et al.
[12] U.S. Pat. No. 5,945,898, Judy et al.
[13] U.S. Pat. No. 6,143,997, Feng et al.

What is claimed is:

1. A magnetic device, comprising:

a substrate;

a movable body attached to said substrate having a rotational axis, said movable body having at least a first end and a second end and comprising a first permanent magnet having a first magnetic field and a permanent magnetization moment;

a second magnetic element;

a third switching magnet having a coil, wherein passing a current through said coil generating a third switching magnetic field which has a main component primarily perpendicular to said permanent magnetization moment in the region where said third switching magnetic field goes through first permanent magnet, and as a result of the vector-cross product of said third switching magnetic field and said permanent magnetization moment producing a torque on said first permanent magnet and causing said movable body to rotate about said rotational axis;

wherein said second magnetic element is arranged with said movable body to maintain said movable body in at least one stable state related to said second magnetic element with or without the presence of said third magnetic field.

2. A magnetic device according to claim 1, wherein said at least one stable state is selected from:

a) said first end of said movable body attracted to said second magnetic element and maintaining a first stable position related to said second magnetic element;

b) said second end of said movable body attracted to said second magnetic element and maintaining a second stable position related to said second magnetic element; or c) said movable body maintaining neutral to said second magnetic element in a third stable position related to said second magnetic element, wherein the net torque acting on said movable body is approximately zero.

3. A magnetic device according to claim 2, wherein said movable body is switched between at least two stable positions by rotation caused by said third magnetic field on said first permanent magnet.

4. A magnetic device according to claim 1, wherein said second magnetic element further comprises soft magnetic material.

5. A magnetic device according to claim 2, wherein said first end of said movable body comprises a first electrical contact and said second magnetic element further comprises a second electrical contact.

6. A magnetic device according to claim 5, wherein said second end of said movable body comprises a third electrical contact and said second magnetic element further comprises a fourth electrical contact.

7. A magnetic device according to claim 5, wherein said movable body is rotated to said first stable position to cause said first electrical contact electrically coupled to said second electrical contact

8. A magnetic device according to claim 6, wherein said movable body is rotated to said second stable position to cause said third electrical contact electrically coupled to said fourth electrical contact.

9. A magnetic device according to claim 6, wherein said movable body is rotated to said third stable position in which there is neither electrical coupling between said first electrical contact and said second electrical contact nor electrical coupling between said third electrical contact and said fourth electrical contact.

10. A magnetic device, comprising:

a substrate;

a movable body attached to said substrate having a rotational axis, said movable body having at least a first end and a second end and comprising a first permanent magnet having a first magnetic field and a permanent magnetization moment;

a second magnetic element;

a third switching magnet for generating a third switching magnetic field which acts on said first permanent magnet and causes said movable body to rotate about said rotational axis;

wherein said second magnetic element is arranged with said movable body to maintain said movable body in at least one stable state related to said second magnetic element with or without the presence of said third magnetic field; wherein said third switching magnet further comprises an electromagnet arranged in such a way that when energized, said third switching magnetic field is primarily perpendicular to said first magnetic field.

11. A magnetic device according to claim 1, wherein said second magnetic element further comprises a soft magnet.

12. A magnetic device according to claim 11, wherein said second magnetic element is arranged with said movable body such that said movable body latches with said second magnet element or said substrate.

13. A magnetic device according to claim 1, wherein said movable body is attached to said substrate by a flexure spring or a raised bar.

14. A magnetic device according to claim 10, which is a magnetic latching relay.

15. A method of operating a magnetic device, comprising the steps of:

providing a movable body attached to said substrate having a rotational axis, said movable body having at least a first end and a second end and comprising a first permanent magnet and a permanent magnetization moment;

providing a second magnetic element;

generating a third switching magnetic field wherein said third switching magnetic field goes through first permanent magnet resulting in a vector-cross product of said third switching magnetic field and said permanent magnetization moment to produce a torque on said first permanent magnet and cause said movable body to rotate about said rotational axis;

arranging said movable body related to said second magnetic element to maintain said movable body in at least one stable state related to said second magnetic element with or without the presence of said third magnetic field.

16. A method according to claim 15, wherein said arranging step comprises at least one of said first and second ends of said movable body inducing a local opposite pole in said second magnetic element and causes said at least one of said first and second ends to be attracted to said second magnetic element and maintains said movable body in said at least one stable state related to said second magnetic element with or without the presence of said third magnetic field, when said at least one of said first and second ends approaches said second magnetic element.

17. A method according to claim 15, further comprising a switching step to select said at least one stable state from:

a) said first end of said movable body attracted to said second magnetic element and maintaining a first stable position related to said second magnetic element;

b) said second end of said movable body attracted to said second magnetic element and maintaining a second stable position related to said second magnetic element; or c) said movable body maintaining magnetically neutral to said second magnetic element in a third stable position related to said second magnetic element.

18. A method according to claim 15, wherein said third magnetic field is generated by an electromagnet.

19. A method according to claim 15, wherein said second magnetic element further comprises a soft magnet.

20. A method according to claim 15, wherein said second magnetic element is arranged with said movable body such that said movable body latches with said second magnet element or said substrate.

* * * * *